US005309204A

United States Patent [19]

Sato et al.

[11] Patent Number: 5,309,204

[45] Date of Patent: May 3, 1994

[54] IMAGE FORMING APPARATUS WITH OPTICAL SYSTEM CONTROL MEANS

[75] Inventors: Kazuo Sato; Hideki Endo; Satoshi Watanabe, all of Hachioji, Japan

[73] Assignee: Konica Corporation, Tokyo, Japan

[21] Appl. No.: 823,662

[22] Filed: Jan. 21, 1992

[30] Foreign Application Priority Data

Feb. 24, 1991 [JP] Japan ..... 3-006969

[51] Int. Cl.[5] ..... G03G 15/28

[52] U.S. Cl. ..... 355/233; 355/208

[58] Field of Search ..... 355/208, 233, 235, 218, 355/228; 364/142, 167, 170, 174, 176, 426, 513

[56] References Cited

U.S. PATENT DOCUMENTS

| | | | |
|---|---|---|---|
| 4,371,254 | 2/1983 | Beery | 355/235 |
| 4,561,771 | 12/1985 | Sugiura | 355/235 |
| 4,568,171 | 2/1986 | Ikenoue | 355/235 |
| 4,645,328 | 2/1987 | Shiraki et al. | 355/233 |
| 4,693,595 | 9/1987 | Kunikawa et al. | 355/298 |
| 4,748,555 | 5/1988 | Miyake et al. | 364/174 |
| 4,794,423 | 12/1988 | Shimuzu et al. | 355/208 |
| 4,954,863 | 9/1990 | Harada et al. | 355/235 X |
| 5,119,136 | 6/1992 | Morikawa | 355/235 |
| 5,162,851 | 11/1992 | Asakawa et al. | 355/233 |

*Primary Examiner*—Leo P. Picard
*Assistant Examiner*—Christopher Horgan
*Attorney, Agent, or Firm*—Frishauf, Holtz, Goodman & Woodward

[57] ABSTRACT

An apparatus for forming an image of a document on a photoreceptor includes a charging device for charging the photoreceptor so as to form an image region, an eliminating device for eliminating a charge on the photoreceptor to form a non-image region, and a scanner for moving from a stop position to scan a document with an exposure light so that a latent image, corresponding to an image of the document, is formed on the image region of the photoreceptor. The scanner also moves backward and stops at the stop position. A position signal corresponding to a predetermined position of the scanner is generated by a signal device. A timer starts counting a time responsive to the position signal. The timer produces a first and second timing signal after the scanner stops at the stop position. The scanner is controlled to move from the stop position to form a next latent image on the photoreceptor in response to the first timing signal, and the eliminating device is controlled to stop eliminating a charge on the photoreceptor so as to provide an image region on the photoreceptor for a next latent image in response to the second timing signal. The eliminating device provides a non-image region on the photoreceptor at a portion of the photoreceptor in a vicinity of an edge portion of the document.

6 Claims, 4 Drawing Sheets

IMAGE FORMING APPARATUS WITH OPTICAL SYSTEM CONTROL MEANS

BACKGROUND OF THE INVENTION

The present invention relates to an image forming apparatus such as a copying apparatus or the like, and especially to an image forming apparatus such as a front loading type apparatus in which small size, low cost and high performance are pursued.

Generally, when copying is conducted by a copying apparatus, a margin is intentionally provided on the leading edge portion of a transfer paper. This is because a transfer paper is wound around a portion of a fixing section of the apparatus when an image exists on the leading edge portion, and there is a high probability that jamming occurs.

In the small and low cost copying apparatus described above, there is an apparatus in which a white plate is provided in the position corresponding to the leading edge of a document, under a document tray so that a margin can be made. There is another technique in which the movement of an optical system after its scanning operation has been started, is detected by a sensor, which triggers an LED for erasing, and the margin is made by erasing a charge on the surface of a photoreceptor.

In the technique in which the aforementioned white plate is provided, there are problems in which an erased amount is changed depending on a copying magnification, or a mechanical shadow occurs.

In the technique in which the margin is made by using the LED for erasing, there is a problem in which confirmation of a position of an optical system is difficult, and therefore, stabilization of an operation to erase a leading edge of an image is difficult, in small sized apparatus. That is, in the small sized apparatus, it is required to limit a width to a minimum in order to reduce installation space, or to speed up starting of an optical scanning operation in order to obtain high performance. In the case where an operation timing of the LED for erasing is determined after the sensor has detected the position of the optical system, the timing of the erasing operation is too late, because a sliding distance of the optical system from the start of its scanning operation to its arrival at a leading edge of a document is short. Further, even when the operation timing can be obtained, there is a case where a stable margin can not be made since the position of the optical system at the time is fluctuated by the influence of undershooting or overshooting at the time of start-up.

In the case described above, it is considered that the operation of the optical system can be precisely controlled by using many ICs, and thereby fluctuation can be prevented. However, this results in the apparatus becoming complicated and of high cost.

SUMMARY OF THE INVENTION

In view of the aforementioned problems, an object of the present invention is to provide an image forming apparatus in which a charge erasing timing and an exposure timing (the starting timing at the leading edge of an image) for a photoreceptor are stabilized by detecting the time of return of an optical system by a sensor.

Control of the present invention is conducted as follows. The control of the optical system is started while the optical system is returning before a scanning operation for a copy; at first, when it is detected, by a position sensor (a brake sensor), that the optical system has arrived at the predetermined position, the speed of the optical system is decreased; the control is changed so that the optical system returns with a constant speed, which is a low speed, after a predetermined time from a detection timing of the sensor; the returning operation with a constant speed, which is a low speed, is continued; then the speed of the optical system is decreased so that the optical system can be stopped; and after the time in which the optical system can be positively stopped has passed, the scanning operation in a going stroke of the optical system is started. The LED for erasing is turned off before the optical system arrives at the leading edge of an image, and exposure is started after a predetermined time. Each operation timing is based on the detection timing of the aforementioned position sensor (the brake sensor).

Since it is too late for the control of the optical system to be started after the scanning operation in the going stroke of optical system has been started, the control of the optical system is started during a returning stroke of the optical system in the preceding scanning operation (for example, in a preliminary scanning operation (EE scanning operation) for an automatic reading of image density), so that disadvantages in which a sliding distance of the optical system from a position where the scanning operation of the optical system starts, to a position where the optical system arrives at the leading edge of the document is short, can be solved.

In this case, when the optical system, which returns at a high speed, crosses the brake sensor, its speed is decreased, and then is changed to a constant low speed in the returning stroke, so that the optical system can be stopped stably in a predetermined position. After that, the speed of the optical system is decreased more so that the optical system can be stopped positively in a predetermined position (or near the position). When the stopped position of the optical system is stabilized, the position of the optical system just after the succeeding scanning operation of the going stroke is started, can be positively specified. Accordingly, the time passage from the time when the optical system has passed the brake sensor, and a position of the optical system corresponding to the time passage can be specified with considerable accuracy. That is, a position control of the optical system, which has been conventionally conducted with a large fluctuation, can be accurately conducted at the sensor timing in a returning stroke control.

Since the timing of the operation of each unit is determined by a timer by making the detection timing of the brake sensor a starting point, a sequence of control can be precisely determined by making the detection timing of the brake sensor a standard.

Therefore, consistency of the position of the optical system representing the detection timing of the brake sensor as a standard with the control timing can be increased, and accordingly, stable erasing and the start of exposure at the leading edge of the image can be realized. Further, these controls can be easily conducted and realized by using computer software technology such as a software timer (a timer which interrupts a CPU by counting standard clocks).

DETAILED DESCRIPTION OF THE PREFERRED EMBODIMENT

Figure 1:
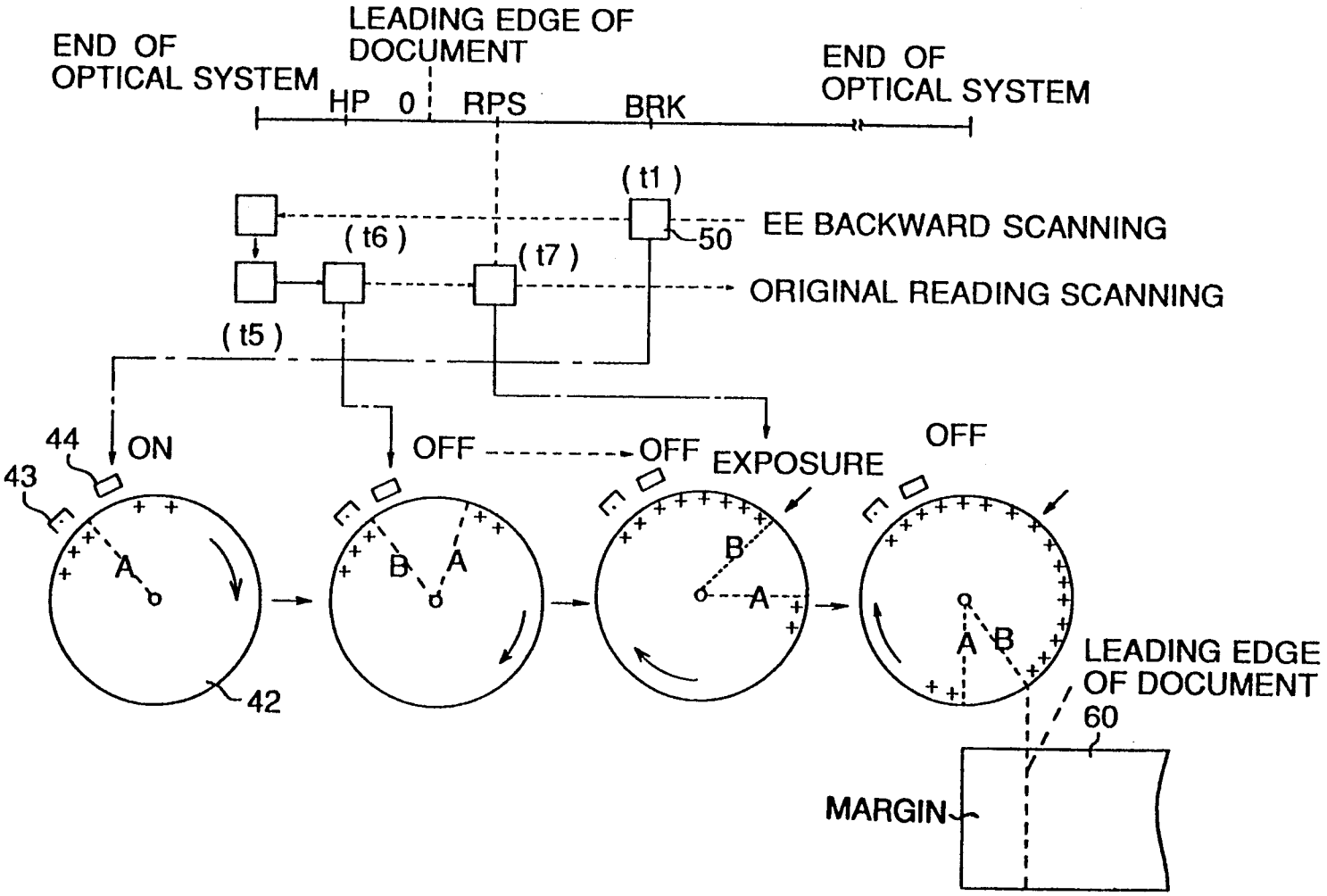
FIG. 1 is a view illustrating basic operations in the present invention by which a margin of a leading edge of a document is made.

Referring to the drawings, an embodiment of the present invention will be described as follows.

Figure 4:
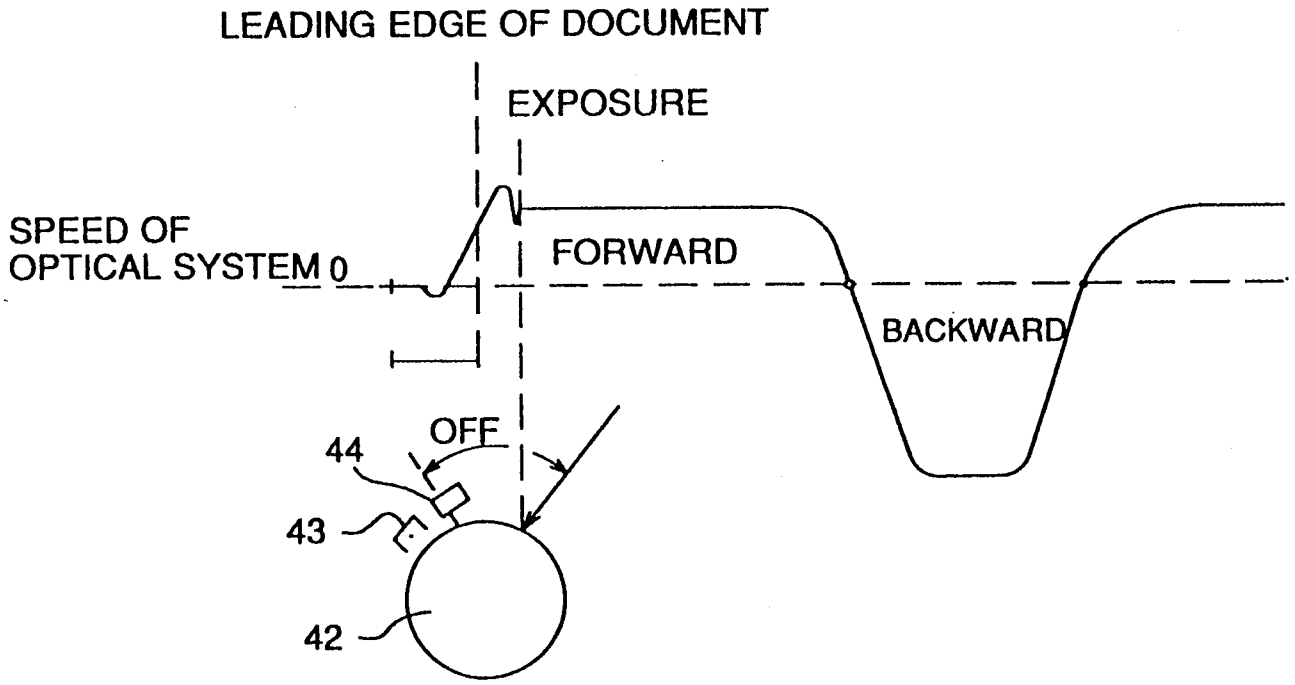
FIG. 4 is a view illustrating a relation between a movement of an optical system, and the on/off timing of an LED for erasing and the exposure timing.

Generally, an optical system in a copying apparatus repeats the scanning operation shown in an upper portion in FIG. 4. When the aforementioned margin of a leading edge of a transfer paper is made, it is required that: after a photosensitive drum 42 has been charged by a charging electrode 43, electric charge is erased by turning an LED for erasing on; the erasing of the electric charge is stopped by turning the LED for erasing off at a predetermined time before exposure (a leading edge of an image) timing; and then the exposure is started when a drum advances a predetermined distance. In the embodiment, the aforementioned controls are conducted in the sequence shown in FIG. 1, and thereby stable image erasing can be realized.

That is, in a returning operation of an optical system 50 in an EE scanning operation (a preliminary scanning operation for automatic density reading), when the optical system passes a brake sensor BRK at time t1 (in the drawing, the time is written in parenthesis), the LED for erasing 44 is turned on so that the electric charge can be erased. After the optical system 50 has passed a home position sensor HP, it is stopped at an end portion of the apparatus, and the scanning operation in a going stroke is started at time t5. The LED for erasing 44 is turned off at time t6, and when the optical system arrives at a register sensor RPS at time t7, exposure is started. A margin is formed at the leading edge portion of a transfer paper 60 by the aforementioned controls.

Figure 2:
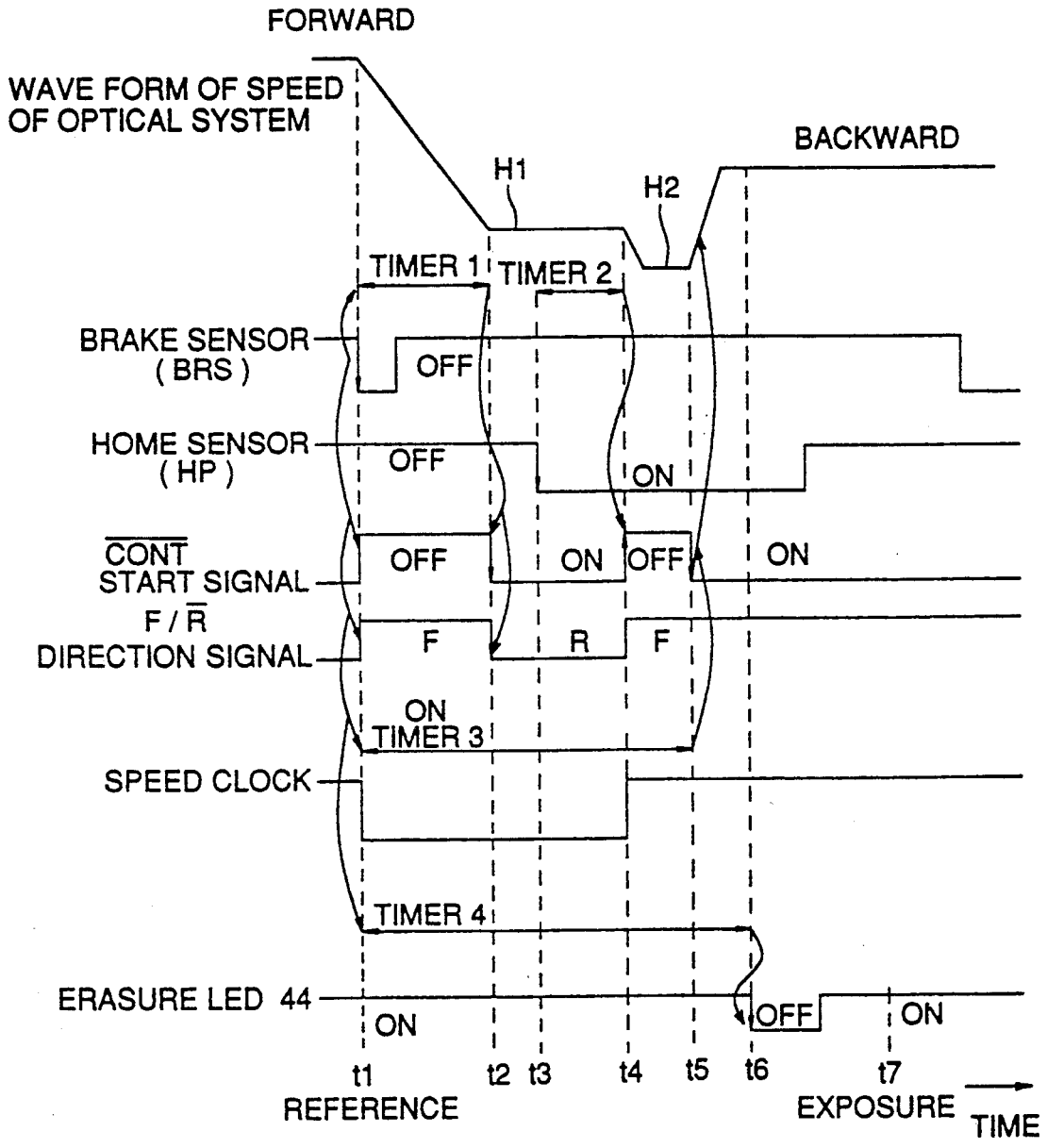
FIG. 2 is a time chart illustrating specific controls.

The aforementioned controls are specifically showed in FIG. 2. Features of the controls are as follows: except when the control is started in the returning operation of the optical system, a position of the optical system is specified by providing a returning portion H1 at a constant low speed and a stopping period H2 with some width in order to stop the optical system positively, in an optical speed wave; and the operation timing for these controls and the LED for erasing is determined by representing time t1, at which the optical system passes the brake sensor, as a standard. In this embodiment, the control timing is generated by using four timers (timers 1, 2, 3 and 4).

That is, when the optical system passes the brake sensor (BRS) at time t1, timers 1, 3 and 4 are turned on, a brake is actuated by the control of a start signal (a signal to control start/stop) and a direction signal, and the returning speed of the optical system is suddenly decreased. When the timer 1 is turned off at time t2, the control of the optical system is changed to a constant low speed control (a portion of H1). When the optical system passes the home position sensor (HP), the timer 2 is turned on. When the timer 2 is turned off at time t4, the brake is actuated, and then the optical system is stopped. After that, when the timer 3 is turned off at time t5, the scanning operation for the going stroke is started, the LED 44 for erasing is turned off at time t6, and the exposure is started at time t7. By the control described above, the consistency of the position of the optical system according to the time passage based on the detection timing of the brake sensor (BRS), with the control timing can be increased, so that stable erasing and the starting of exposure at the leading edge of the image can be realized. Further, since the control is conducted by using the EE scanning operation, an excessive scanning operation is not necessary, and the apparatus can be convenient.

Figure 3:
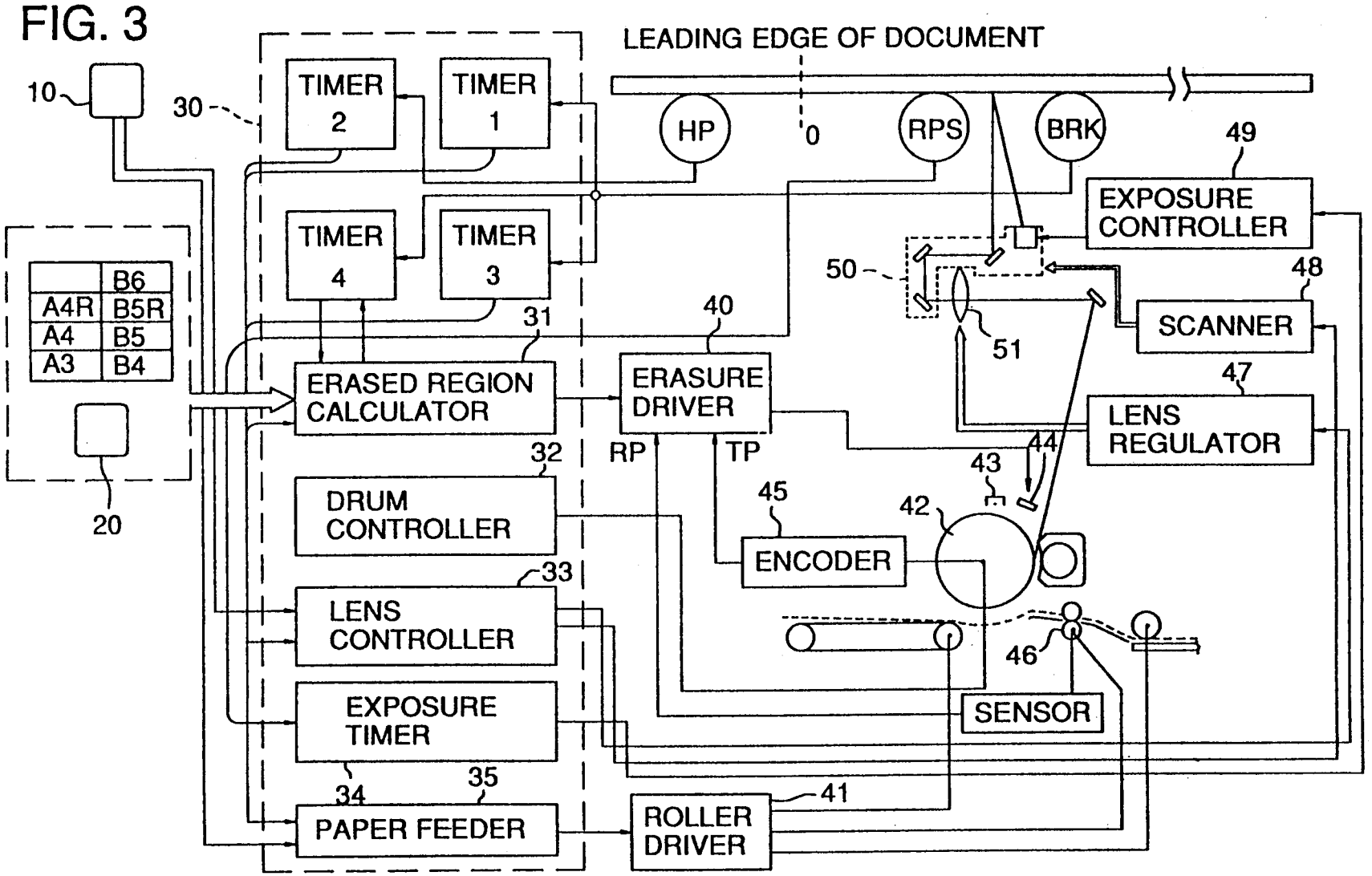
FIG. 3 is a view showing an example of a structure of a copying apparatus by which operations shown in FIG. 2 are conducted.

FIG. 3 shows an example of a structure of the copying apparatus in which the above-described operation is conducted. A control section 30 comprises: four timers 1, 2, 3 and 4; an erased region calculation means 31; a drum control means 32; an optical system and main lens control means 33; an exposure timing control means 34; and a paper feeding means 35, wherein each means starts the control when a copy magnification factor is set by a magnification selection key 20, and a copy button 10 is pressed.

The optical system 50 is scanned by an optical system scanning means 48, an exposure unit is driven by an exposure control means 49, and a main lens 51 is controlled by a main lens control means 47. The rotation of a photosensitive drum 42 is controlled to a constant speed by the aforementioned drum control means 32. A roller of a paper feeding system is driven by a roller drive section 41, and the paper feed timing is regulated through a roller 46 (for example, by using a shutter). The LED for erasing 44 is driven by an LED for erasing drive means 40, and the drive timing is determined according to a control signal from the erased region calculation means 31, a signal TP which shows a revolving phase of the photosensitive drum 42, and which is obtained from an encoder 45, and a signal RP showing the paper feed timing. As described above, each timer is triggered by a detection signal from the brake sensor (BRS) and the home position sensor HP. The control section 30 is simply structured by hardware/software engineering of a computer, and is advantageous in cost.

As described above, in the present invention, the control is started in a returning stroke of the optical system, a position of the optical system corresponding to the time passage from the time at which the optical system passes the brake sensor is specified, and the sequence of control timings is determined by timers by making the time at which the brake sensor is passed a standard. Therefore, by using the simple engineering described above, the timing for erasing a charge and the exposure timing (the starting timing at a leading edge of an image) can be stabilized, and an image forming apparatus which is small, of low cost, and has superior functions and high performance, such as a front loading type apparatus, can be obtained.

What is claimed is:

1. An apparatus for forming an image of a document on a photoreceptor, comprising:

charging means for charging said photoreceptor with an electric charge so as to form an image region;

eliminating means for eliminating a charge on said photoreceptor to form a non-image region;

scanning means for moving from a stop position along a scanning path in a forward direction, to scan a document with an exposure light so that a latent image, corresponding to an image of said document, is formed on said image region of said photoreceptor, and for further moving in a backward direction along said scanning path and for stopping at said stop position;

said scanning means moving in both said forward and backward directions along said scanning path for each latent image formed when a plurality of latent images are being formed successively;

signal means for generating a position signal corresponding to a predetermined position of said scanning means on said scanning path;

timer means for starting a counting of a time in response to said position signal, said timer means producing both a first timing signal after a first counting of a first predetermined time period and a second timing signal after a second counting of a second predetermined time period so that said first and second timing signals are produced by said timer means after said scanning means stops at said stop position; and control means for controlling said scanning means to start a next forward movement for a next latent image to be formed on said photoreceptor in response to said first timing signal and for controlling said eliminating means to stop eliminating a charge on said photoreceptor so as to provide an image region on said photoreceptor for a formation of said next latent image in response to said second timing signal so that said eliminating means provides a non-image region on said photoreceptor at a portion on said photoreceptor in a vicinity of an edge portion of said document.

2. The apparatus of claim 1, wherein said scanning means further comprises means for conducting a preliminary scan to read an image density of said document, and wherein a backward movement in said preliminary scan is used as a previous backward movement of said scanning means before the next forward movement of said scanning means.

3. The apparatus of claim 1, wherein said control means includes means for controlling said elimination means to start eliminating a charge in response to said brake timing signal.

4. The apparatus of claim 1, wherein:

said signal generation means includes first detecting means for detecting a movement of said scanning means in said backward direction and generates a brake timing signal in accordance with a detection result of said first detecting means; and said signal generation means provides said brake timing signal as said position signal to said timer means.

5. The apparatus of claim 4, wherein:

said signal generation means further includes second detecting means for detecting a movement of said scanning means in said backward direction, and for outputting a stop timing signal.

6. The apparatus of claim 5, wherein said control means includes means further for reducing a speed of movement of said scanning means in response to said brake timing signal and for stopping said scanning means at said stop position in response to said stop timing signal.

* * * * *